US005884404A

United States Patent [19]

Ohle et al.

[11] Patent Number: 5,884,404

[45] Date of Patent: Mar. 23, 1999

[54] INNER CUTTER FOR A DRY SHAVING APPARATUS

[75] Inventors: Manfred Ohle, Walldürn; Carlo Wojciechowski, Mühlheim; Bernd Stassen, Idstein, all of Germany

[73] Assignee: Braun Aktiengesellschaft, Frankfurt, Germany

[21] Appl. No.: 737,539

[22] PCT Filed: May 25, 1995

[86] PCT No.: PCT/EP95/01936

§ 371 Date: Nov. 14, 1996

§ 102(e) Date: Nov. 14, 1996

[87] PCT Pub. No.: WO96/01169

PCT Pub. Date: Jan. 18, 1996

[30] Foreign Application Priority Data

Jul. 5, 1994 [DE] Germany ..... 44 23 503.8

[51] Int. Cl.[6] ..... B26B 19/04

[52] U.S. Cl. ..... 030/346.51; 30/43.92

[58] Field of Search ..... 30/43.92, 43.6, 30/43.8, 346.51

[56] References Cited

U.S. PATENT DOCUMENTS

| | | | |
|---|---|---|---|
| 2,037,957 | 4/1936 | Andis | 30/43.92 |
| 2,098,849 | 11/1937 | Amsler | 30/43.92 |
| 2,281,250 | 4/1942 | Ruskin | 30/346.51 |
| 2,307,471 | 1/1943 | Schaffer et al. | 30/346.51 |
| 3,060,569 | 10/1962 | Oliver et al. | 30/43.92 |
| 3,343,258 | 9/1967 | Loner | 30/43.92 |
| 4,510,687 | 4/1985 | Groothuis et al. | 30/43.92 |

FOREIGN PATENT DOCUMENTS

| | | |
|---|---|---|
| A 0 080 303 | 6/1983 | European Pat. Off. . |
| 73 35 278 | 5/1974 | Germany . |
| 526 677 | 9/1940 | United Kingdom . |

OTHER PUBLICATIONS

Braun Flex Control 4515 universal; Braun Flex Control 4520 universal; Braun Flex Control 4525 universal (Print Reference 5–585–075/XI–91).

Braun Flex Control 4515 universal; Braun Flex Control 4520 universal (Print Reference 5–585–088/V–93).

Copy of International Search Report dated Apr. 10, 1995.

*Primary Examiner*—Hwei-Siu Payer

*Attorney, Agent, or Firm*—Fish & Richardson P.C.

[57] ABSTRACT

An inner cutter for a shaving head provided with an outer cutter, of a dry shaving apparatus, the inner cutter including several cutter blades in parallel relative alignment which are formed by means of slots cut into an elongate bar essentially transversely to the bar longitudinal extent, with the ends of the slots being of an arcuate configuration and each cutter blade being provided with a wall thickness D diminishing from a vertex SP of an arcuate end of a slot in the direction of a crest line SP of the bar, wherein the reduction of wall thickness D, extending from the vertex SP, covers an area B which is greater than half the relative distance A of two adjacent cutter blades in the area of the crest line SL.

20 Claims, 5 Drawing Sheets

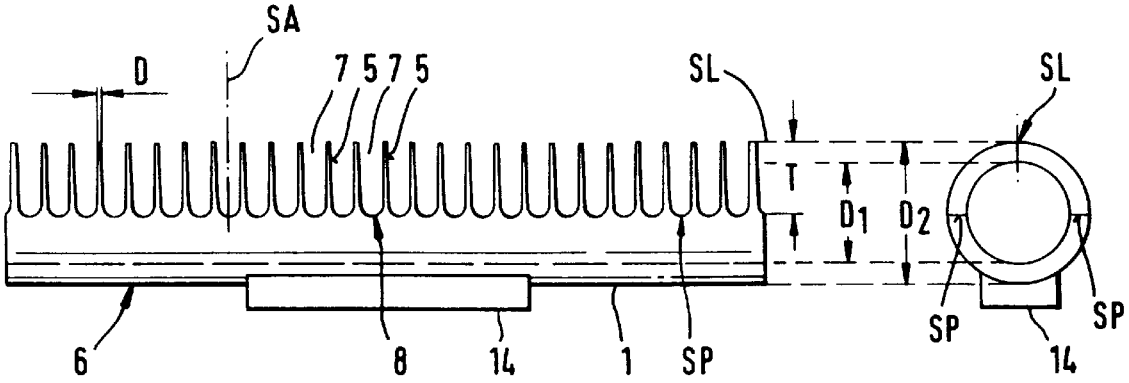
Fig. 2
Fig. 2a
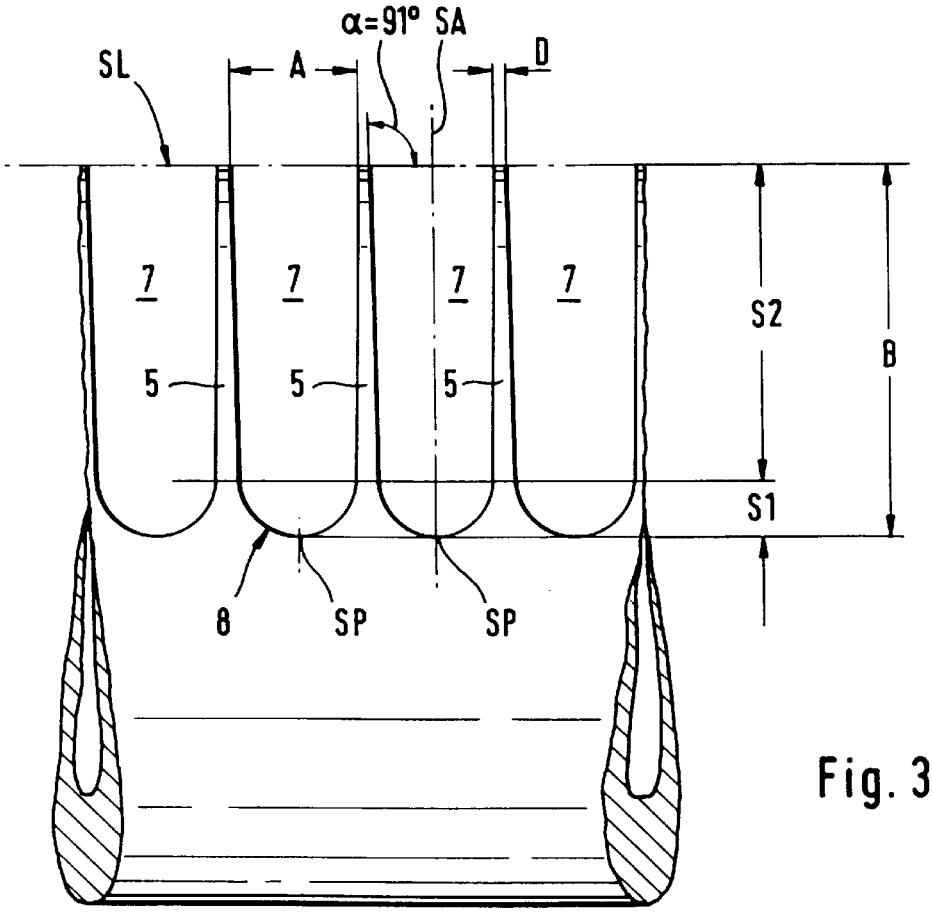
Fig. 3

INNER CUTTER FOR A DRY SHAVING APPARATUS

BACKGROUND OF THE INVENTION

This invention relates to an inner cutter for a shaving head provided with an outer cutter, of a dry shaving apparatus, the inner cutter including several cutter blades in parallel relative alignment which are formed by means of slots cut into an elongate bar essentially transversely to the bar longitudinal extent, with the ends of the slots being of an arcuate configuration and each cutter blade being provided with a wall thickness that diminishes from the vertex of each arcuate end of each slot in the direction of a crest line of the bar.

An inner cutter of the type initially referred to is known in the art—see page 3 of the operating instructions for the "Braun Flex Control 4515 universal", "Braun Flex Control 4520 universal", and "Braun Flex Control 4525 universal" dry shaving apparatus, print reference 5585-075/XI-91. In these known dry shaving apparatus, two inner cutters manufactured from an elongate tubular bar are arranged on a mounting member. The cutter blades of the respective inner cutter are formed by means of slots cut into the tubular bar from a crest line thereof. The cutter blades obtained by the slots extending parallel to each other have their sides in parallel arrangement, whereby the wall of a cutter blade is of a uniform thickness up to the arcuate ends of each slot. The end of each slot is shaped in semi-circular form of a radius corresponding to half the relative distance of two adjacent cutter blades. In inner cutters made from bars, the wall thickness of a cutter blade is 0.2 mm and more. Cutter blades having a wall thickness of the dimension identified have an adverse effect on the cutting action of inner cutters.

It is an object of the present invention to improve the cutting action of an inner cutter of the type initially referred to.

SUMMARY OF THE INVENTION

According to the present invention, this object is accomplished in an inner cutter of the type initially referred to in that the reduction of wall thickness D extends from the vertex SP to the crest line SL.

A further solution of the object of the present invention consists in that the reduction of wall thickness D from the vertex SP covers an area B which is greater than half the relative distance A of two adjacent cutter blades in the area of the crest line SL, and that the geometric form of cross-section of the area B is determined by means of a series arrangement of several radii.

According to still another solution of the object of the present invention, the reduction of wall thickness D from the vertex SP covers an area B whose geometric form of cross-section is essentially parabolic.

According to yet another solution of the object of the present invention, the reduction of wall thickness D from the vertex SP covers an area B whose geometric form of cross-section is essentially elliptical.

The solutions of the inventions afford a plurality of advantages. By reason of the reduction of the wall thickness D of the cutter blades as disclosed in the inventions, which reduction, by comparison with the initially identified inner cutter known from the art, extends in the direction of the crest line SL of the bar and exceeds half the relative distance A of two adjacent cutter blades, it is possible to manufacture inner cutters in which the cutter blades have a wall thickness D of less than 0.2 mm, less than 0.15 mm, and even less than 0.1 mm, without involving the risk of breakage. Further, this reduction of wall thickness D of the cutter blades which, according to the present invention, is obtained over a major area, results in a smaller amount of overlap of the cutter blades with the perforations in the outer cutter of a shaving head, whereby the penetration of hairs into the perforations of the outer cutter is materially facilitated. In this manner, the cutting result of the dry shaving apparatus is significantly improved. The increase in the wall thickness D of a cutter blade as seen looking from the crest line SL of a cutter blade towards the vertex SP of a slot prevents breakage of the cutter blades under cutting loads during use of the dry shaving apparatus. In addition, it has shown that the reduction of wall thickness D of the cutter blade in the direction of the crest line SL which, according to the inventions, extends over a major area B, produces a greater flexibility of the cutter blade than is obtained with a cutter blade whose wall thickness D is uniform from the crest line SL to the circular end of a slot. The result is an improved oscillating action of the cutter blades of an inner cutter of the inventions, in addition to improving the cutting performance of the inner cutter as it cooperates with the outer cutter of a shaving head of a dry shaving apparatus. A further advantage of the inventions results from the geometric forms of slot cross-sections derivable from the diminishing wall thickness D of the cutter blades, which forms, in the absence of nooks and/or broken lines in the respective sides of the cutter blades, allow the cutter blades to be cleaned of adhering hair dust readily using, for example, a brush.

In a further embodiment of the present invention, the slot is subdivided into at least two areas B and C of differing geometric forms of cross-section.

In still another embodiment of the present invention, the geometric form of cross-section of area C is essentially rectangular. As an alternative to this embodiment, the form of cross-section of area C may also be essentially trapezoidal.

To ensure that cutter blades do not break when exposed to cutting loads during shaving, one embodiment of the present invention is characterized by arcuate transitions of differing geometric forms of cross-section of adjacent areas B and C.

A very small amount of overlap of the cutter blades in the area of the crest line SL with the perforations of an outer cutter is accomplished in that the wall thickness D of a cutter blade formed by two slots is less than 0.15 mm in the area of the crest line. Preferably, the depth of the slots from the crest line amounts to at least half the diameter of the bar.

In a preferred embodiment of the present invention, the bar is fabricated from a hollow body.

Some embodiments will be described in the following with reference to the accompanying drawings.

BRIEF DESCRIPTION OF THE DRAWINGS

FIG. 2 is a view of an inner cutter having a multiplicity of cutter blades arranged parallel to each other;

FIG. 2*a* is a view of an inner cutter of FIG. 2 having a tubular cross-section;

FIG. 3 is a view of a geometric form of cross-section of slots and the resultant wall thicknesses of cutter blades;

DETAILED DESCRIPTION

Figure 1:
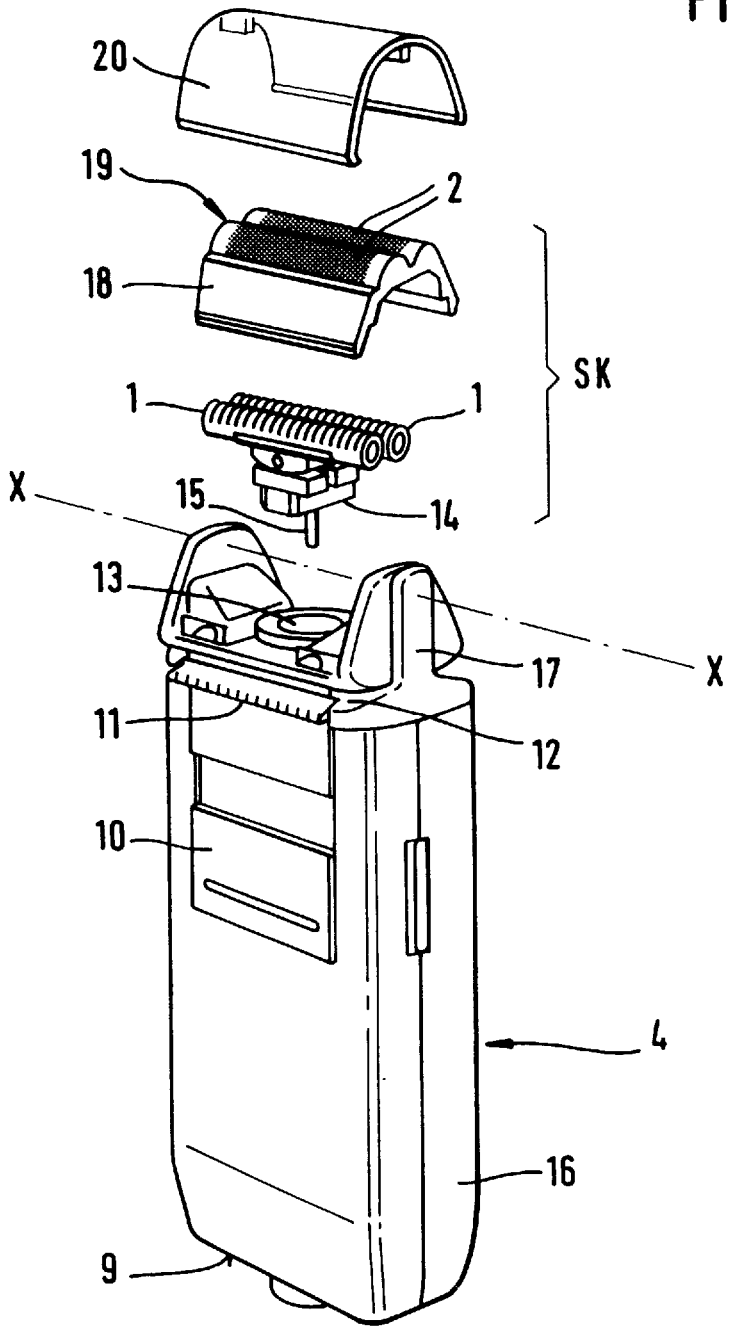
FIG. 1 is an exploded view showing the components of a dry shaving apparatus in perspective view.

FIG. 1 shows a perspective view of a dry shaving apparatus 4 in which reference numeral 9 identifies a housing, 10 an On/Off switch, 11 a long-hair trimmer assembly, 12 a housing upper end, 13 an opening provided in the housing upper end 12, 15 a drive pin provided on a mounting member 14, reference numeral 17 denotes bracket arms forming respective extensions of housing narrow sides 16, and SK designates a shaving head assembly pivotally mounted about an axis X—X between the two bracket arms 17. The bracket arms 17 constitute part of a housing head portion fabricated from a plastic, or they are integrally formed with the housing 9.

As an alternative to this representation of FIG. 1, the shaving head assembly SK may also be immovably disposed on the housing 9 of a dry shaving apparatus 4.

The shaving head assembly SK shows a pair of parallel shaving heads comprised of two inner cutters 1 as well as outer cutters 2 fitted over these inner cutters 1. The outer cutters 2 may be composed of, for example, one or two shaving foils 19 attached to an exchangeable frame 18 in arched form. A guard 20 seatable on the exchangeable frame 18 serves to protect the outer cutters 2. The inner cutters 1 are resiliently mounted on a common mounting member 14. The mounting member 14 has a drive pin 15 coupling it through the opening 13 to an electric drive mechanism provided in the housing 9.

FIG. 2 shows one embodiment of an inner cutter 1. The inner cutter 1 is comprised of an elongate bar 6, that is, it extends transversely to the longitudinal extent of the dry shaving apparatus 4, as shown in FIG. 1. The bar 6 may be formed from a solid rod—see FIG. 10—or from a rod-shaped hollow body as, for example, a tube—see FIG. 2*a*—, or from a rod-shaped body shaped in U-form—see FIG. 8 or FIG. 9. The cross-section of the bar 6 may be in the form of a circle, a square, a T, a double-T, or a U.

One embodiment of a bar 6 from which an inner cutter 1 is manufactured will be described in more detail in the following with reference to FIG. 2*a*. In this embodiment, the bar 6 is a tubular body with a tube outside diameter $D_2$, of 6.5 mm, approximately, and a tube inside diameter $D_1$, of 4.4 mm, approximately, that is, the tube has a wall thickness of 1 mm, approximately. This tubular bar 6 is provided with a plurality of slots 7 cut into the bar transversely to its longitudinal extent starting from a crest line SL using, for example, a grinding operation whereby the cutter blades 5 are formed. The ends 8 of the slots 7 are of an arcuate configuration, with the outermost point on the arc line being referred to as the vertex SP—see FIG. 3. Starting from a crest line SL common to all cutter blades 5, the depth, T, of the slots 7 from this crest line SL to the vertices SP of the arcuate ends of the slots 7 is dimensioned such that it corresponds approximately to half the outside diameter D2 of the tubular bar 6. Fastened to the side of the tubular bar 6 opposite the crest line SL is a mounting member 14 for transmitting the driving motion to the inner cutter 1. Details of the cutter blade configuration and the wall thickness D of the cutter blades 5 of the inner cutter illustrated in FIG. 2 and FIG. 2*a*, which wall thickness is derivable from the geometric form of the slots 7, are shown in FIG. 3 and will be described in greater detail in the following.

FIG. 3 shows three cutter blades 5 obtained by means of four slots 7 cut into the tubular bar 6—see FIG. 2 and FIG. 2*a*. The wall thickness D of each cutter blade 5 is characterized in that it diminishes progressively from the respective vertex SP of an arcuate end 8 of a slot 7 in the direction of the crest line SL of the bar 6, this reduction of wall thickness D extending from the vertex SP up to the crest line SL. The reduction of wall thickness D from the vertex SP in the direction of the crest line SL results in a correspondingly increasing gap width of a slot 7 from its end 8 to the crest line SL. In the embodiment of FIG. 3, the geometric form of cross-section of the slot 7 is subdivided into two segments S1 and S2 of different cross-sectional forms covering the area B from the vertex SP to the crest line SL. Segment S1 which forms the end 8 of the slot 7 is of a semi-circular cross-section known per se, while the adjoining segment S2 is of a trapezoidal cross-section terminating in the area of the crest line SL. The angle of inclination of the sides of the trapezoid adjoining the semi-circular arc of segment S1 and sloping outwardly is 1 degree, approximately. By means of such a combination of different geometric forms of cross-section of parallel slots 7 cut into a tubular bar 6, cutter blades 5 are obtained whose wall thickness D diminishes from the vertex SP to a particularly thin wall thickness D in a manner free from corners, steps and broken lines. With such a geometric form of cross-section of the slot 7, it is possible to produce cutter blades 5 to a wall thickness D of less than 0.2 mm, and even less than 0.1 mm, without incurring the risk of these cutter blades 5 breaking, neither in the course of production nor at a later stage when a dry shaving apparatus 4 equipped with such an inner cutter 1 is put to use.

Figure 4:
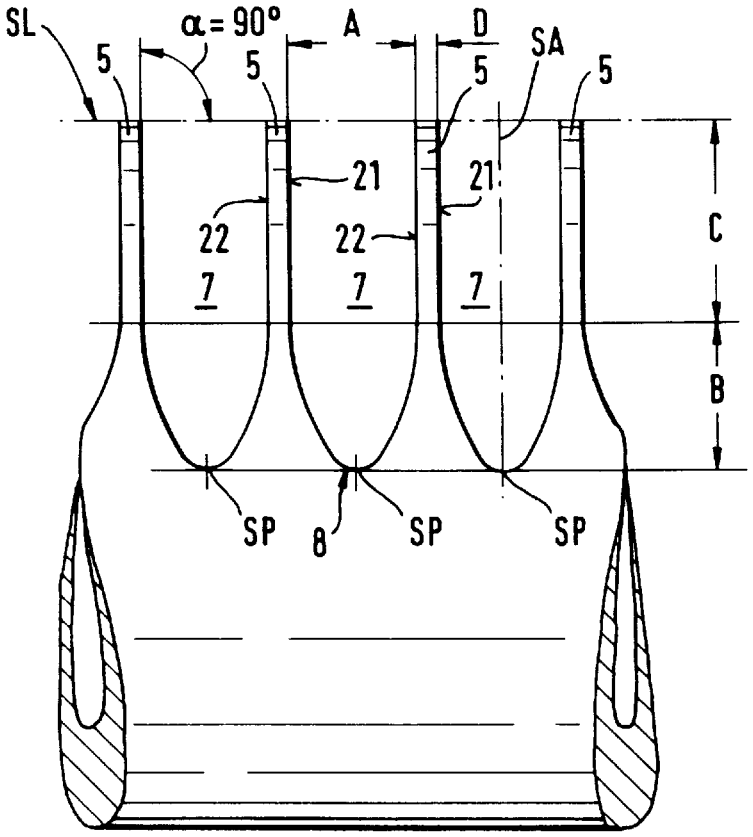
FIG. 4 is a view of a geometric form of cross-section of a slit illustrating another embodiment, and the resultant wall thickness of a cutter blade.

FIG. 4 shows a further embodiment of an inner cutter 1 in which the geometric form of cross-section of the slots 7 differs from that of the embodiment of FIG. 3. Wall thickness, D, of cutter blades 5 diminishes as one moves in the direction from region B to region C. The area B extending from the vertex SP of a slot 7 is shaped in the manner of a parabola. The adjoining area C extending up to the crest line SL is of a rectangular configuration. Owing to this rectangular shape of area C, all sides 21 and 22 of the cutter blades 5 extend parallel to each other within area C. Starting from vertex SP, the longitudinal extent of the parabolic area B is greater than the distance A. When the inner cutter 1 is engaged against an outer cutter 2, the cutting angle $\alpha$ is 90 degrees, whilst in the embodiment of FIG. 3 it is slightly greater than 90 degrees, for example, 91 degrees, as a result of the trapezoidal geometry of segment S2.

Figure 5:
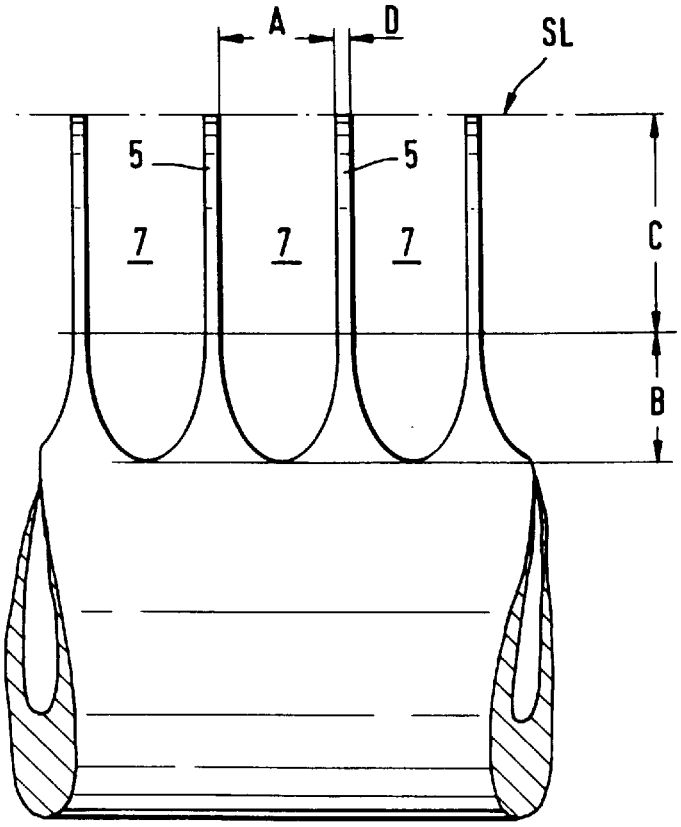
FIG. 5 is a view of a geometric form of cross-section of a slot illustrating a further embodiment, and the resultant wall thickness of a cutter blade.

FIG. 5 shows a further embodiment of an inner cutter 1 in which, for example, other than in the embodiment of FIG. 4, for the purpose of diminishing the wall thickness D, the geometric form of cross-section of area B is elliptical over a distance exceeding half a relative distance A of two adjacent cutter blades 5 in the area of the crest line SL.

Figure 6:
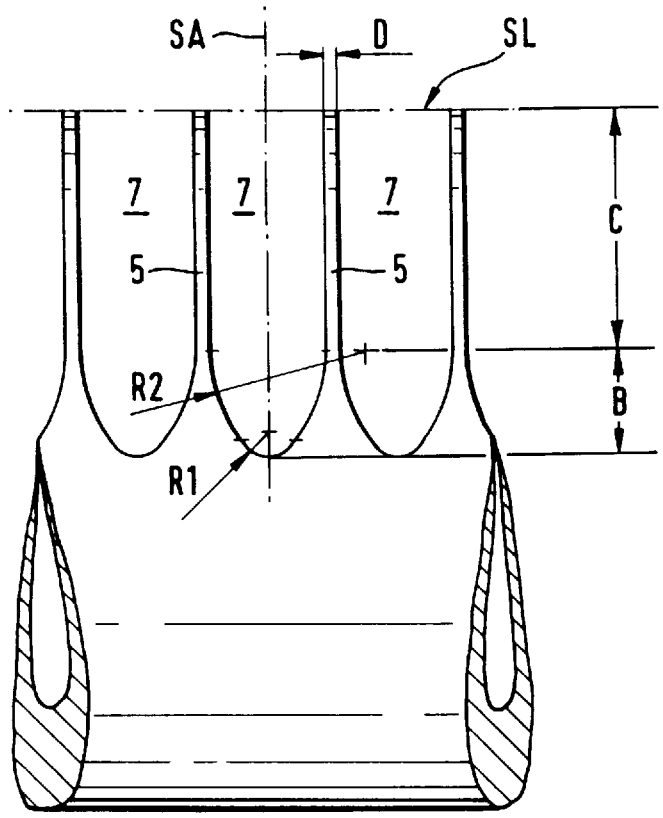
FIG. 6 is a view of a geometric form of cross-section of a slot illustrating still another embodiment, and the resultant wall thickness of a cutter blade.
Figure 7:
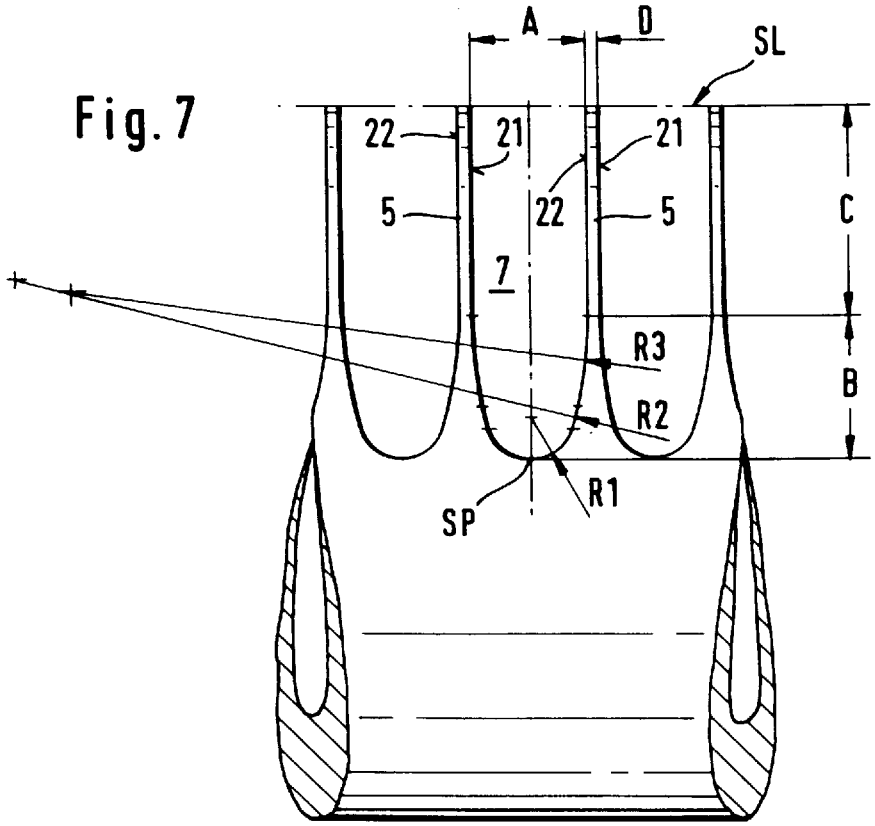
FIG. 7 is a view of a geometric form of cross-section of a slot illustrating yet another embodiment, and the result wall thickness of a cutter blade.

The embodiment of FIG. 6 shows, by way of example, two cutter blades 5 formed by three slots 7. Other than in the embodiments illustrated and described with reference to FIG. 4 and FIG. 5, in the embodiment of FIG. 6 the geometric form of cross-section of area B is determined by a series arrangement of several radii of which two radii R1 and R2 are shown by way of example. These radii may have their respective centers both on the axis of symmetry SA dividing the geometric form of cross-section of a slot 7 into two congruent halves, or outside this axis of symmetry SA, as is the case with radius R2. By serially arranging a major number of radii R1, R2, R3 . . . RN of different magnitudes as shown in the embodiment of FIG. 7, it is ensured that the sides 21, 22 of the cutter blades 5 extend without any corners, steps or broken lines, that is, in an arcuate fashion, in the area B from the vertex SP in the direction of the crest line SL.

Figure 8:
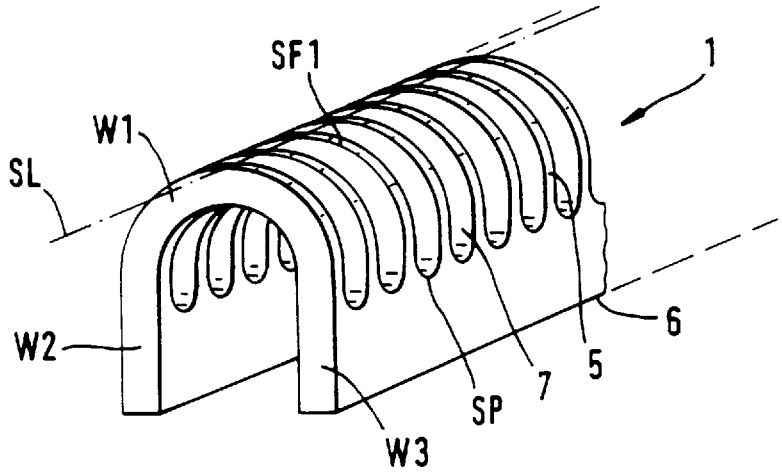
FIG. 8 is a view of a geometric form of cross-section of a bar.

FIG. 8 shows a further embodiment of an inner cutter 1 made from an elongate bar 6. The bar 6 is formed of wall portions W1, W2 and W3 essentially shaped in U fashion. The bar 6 has a curved cutting surface SF1, with a common crest line SL for all slots 7 that are cut into the bar 6 from this crest line SL. The curved wall portion W1 may be arched in the manner of a semi-circle or a parabola, for example, while the adjoining wall portions W2 and W3 may extend parallel to each other or at a relative inclination, for example. By providing slots 7 extending from the crest line SL to the respective vertices SP and giving them geometric forms of cross-section as described with reference to FIGS. 2 to 7, cutter blades 5 result whose wall thickness D diminishes over a major area from the respective vertices SP to the crest line SL of the bar.

Figure 9:
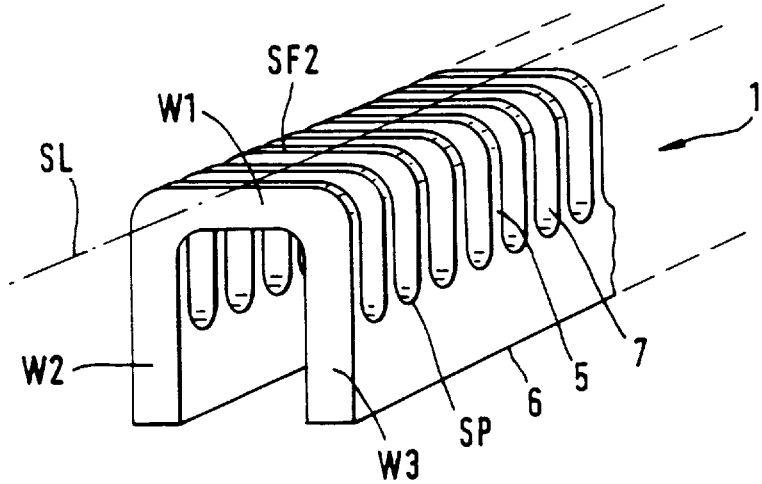
FIG. 9 is a view of a further geometric form of cross-section of a bar.

FIG. 9 shows an inner cutter 1 fabricated from a bar 6 whose wall portions W1, W2 and W3, which combine to form a U, are essentially at right angles to each other. Other than in FIG. 8, the embodiment of FIG. 9 shows the wall portion W1 as a plane structure, whereby a plane cutting surface SF2 is obtained whose center line is provided as the crest line SL for the slots 7.

Figure 10:
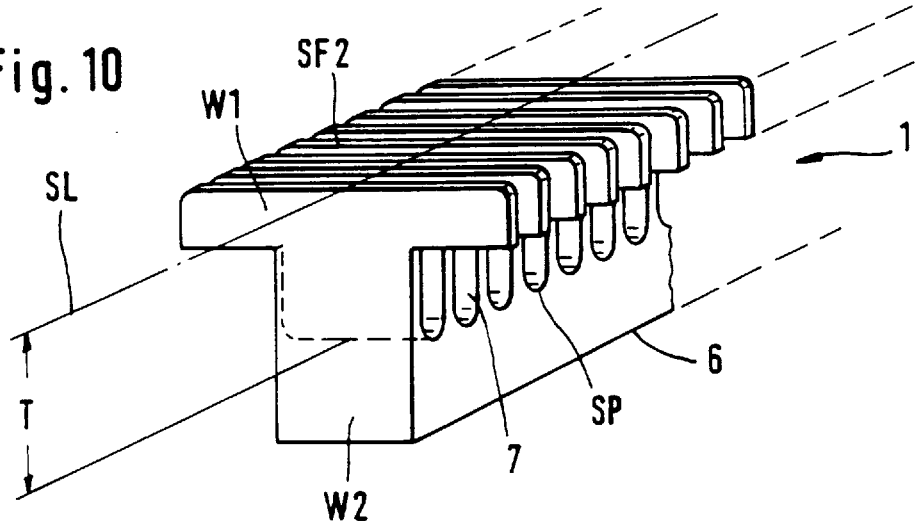
FIG. 10 is a view of still another geometric form of cross-section of a bar.

FIG. 10 shows a further embodiment of an inner cutter 1 formed from a tee bar 6. Plural slots 7 extending from the plane cutting surface SF2 through the wall portion W1 and partially extending into the wall portion W2 are provided, their depth, T, measured from the crest line SL to the respective vertices SP of the individual slots 7 amounting to at least half the thickness of the bar 6, measured from the crest line SL to an opposite outer wall of the bar 6. The embodiment of FIG. 10 differs from the embodiments of FIGS. 2 to 7 in the employment of a solid bar 6 instead of a hollow body.

What is claimed is:

1. An inner cutter for a shaving head of a dry shaving apparatus, the inner cutter comprising a multiplicity of cutter blades in parallel relative alignment which are formed by cutting slots into an elongate bar of material, said slots cut essentially transversely to the longitudinal extent of the bar, each slot having an arcuate-shaped end region, each of the cutter blades having a wall thickness as measured along the longitudinal direction of the bar that continuously diminishes from a vertex of the arcuate end region of at least one slot adjacent to that blade to a value D at a crest line of the bar, and each of said cutter blades also having a width W as measured transversely to the longitudinal direction of the bar, wherein D is substantially less than W.

2. An inner cutter according to claim 1, wherein the wall thickness of each of the multiplicity of blades has a minimum value of about 0.2 mm.

3. An inner cutter according to claim 1, wherein the wall thickness of each of the multiplicity of blades has a taper of about 2°.

4. An inner cutter according to claim 1, wherein W is about 1 mm.

5. An inner cutter according to claim 4, wherein D is less than about 0.2 mm.

6. An inner cutter according to claim 4, wherein D is less than about 0.1 mm.

7. An inner cutter for a shaving head of a dry shaving apparatus, the inner cutter comprising a multiplicity of cutter blades in parallel relative alignment which are formed by slots cut into an elongate bar, said slots cut essentially transversely to the longitudinal extent of the bar, each slot having an arcuate-shaped end region and each of the cutter blades having a wall thickness as measured along the longitudinal direction of the bar that over the arcuate-shaped end region of at least one slot adjacent to that blade continuously diminishes from a vertex of that arcuate-shaped end region and is uniform from that arcuate-shaped end region to a crest line of the bar, wherein the blades are separated by a distance that is at least as great as a distance A, wherein the arcuate-shaped end region has a height of B, and wherein B is at least as large as 0.5 A.

8. An inner cutter according to claim 7, wherein the reduction of wall thickness from the vertex defines an area having a length which is greater than half the relative distance between two adjacent cutter blades near the crest line, and the geometric form of the area is determined by a series arrangement of a multiplicity of radii.

9. An inner cutter according to claim 7, wherein the reduction of wall thickness from the vertex defines an area whose geometric form is substantially parabolic.

10. An inner cutter according to claim 7, wherein the reduction of wall thickness from the vertex defines an area whose geometric form is substantially elliptical.

11. An inner cutter according to claim 7, wherein the wall thickness of each cutter blade is less than 0.15 mm, approximately, in the area of the crest line.

12. An inner cutter according to claim 11, wherein a depth of the slots from the crest line is at least half a diameter of the bar.

13. An inner cutter according to claim 12, wherein the bar is fabricated from a hollow body.

14. An inner cutter according to claim 11, wherein the wall thickness of each cutter blade is about 0.1 mm. in the area of the crest line.

15. An inner cutter according to claim 7, wherein B is at least as large as A.

16. An inner cutter according to claim 7, wherein the arcuate-shaped end region is parabolically-shaped.

17. An inner cutter according to claim 7, wherein the arcuate-shaped end region is elliptically-shaped.

18. An inner cutter for a shaving head of a dry shaving apparatus, the inner cutter comprising a multiplicity of cutter blades in parallel relative alignment which are formed by slots cut into an elongate bar, said slots cut essentially transversely to the longitudinal extent of the bar, each slot having an arcuate-shaped end region and each of the cutter blades having a wall thickness as measured along the longitudinal direction of the bar that is uniform from the arcuate-shaped end region of at least one slot adjacent to that blade to a crest line of the bar, wherein the arcuate shape of the arcuate-shaped end region for each of the slots is characterized by a plurality of different radii.

19. An inner cutter according to claim 18, wherein the arcuate shape of the arcuate-shaped end region for each of the slots is characterized by two different radii.

20. An inner cutter according to claim 18, wherein the arcuate shape of the arcuate-shaped end region for each of the slots is characterized by more than two different radii.

* * * * *